United States Patent [19]

Feuling

[11] Patent Number: 4,976,231

[45] Date of Patent: Dec. 11, 1990

[54] CURVED INTAKE DUCT HAVING IMPROVED FLOW CHARACTERISTICS

[76] Inventor: James J. Feuling, 4035 N. Ventura Ave., Ventura, Calif. 93001

[21] Appl. No.: 356,017

[22] Filed: May 22, 1989

Related U.S. Application Data

[62] Division of Ser. No. 227,472, Aug. 1, 1988, Pat. No. 4,838,219.

[51] Int. Cl.[5] ..... F02F 1/00

[52] U.S. Cl. ..... 123/188 M; 123/188 GC

[58] Field of Search ..... 123/188 M, 52 M, 188 GC

[56] References Cited

U.S. PATENT DOCUMENTS

| | | | |
|---|---|---|---|
| 4,095,578 | 6/1978 | Allara et al. | 123/188 M |
| 4,159,011 | 6/1979 | Sperry | 123/188 M |
| 4,228,653 | 10/1980 | Sperry | 123/188 M |
| 4,503,819 | 3/1985 | Okumura et al. | 123/188 M |
| 4,537,028 | 8/1985 | Humke | 123/188 M |
| 4,553,514 | 11/1985 | Namba et al. | 123/188 M |
| 4,606,308 | 8/1986 | Furlong | 123/188 M |
| 4,700,669 | 10/1987 | Sakurai et al. | 123/188 M |
| 4,838,219 | 6/1989 | Feuling | 123/188 M |

FOREIGN PATENT DOCUMENTS

| | | | |
|---|---|---|---|
| 1261486 | 6/1960 | France | 123/188 M |
| 0158319 | 9/1983 | Japan | 123/188 M |

*Primary Examiner*—Andrew M. Dolinar
*Assistant Examiner*—M. Macy
*Attorney, Agent, or Firm*—Frank D. Gilliam

[57] ABSTRACT

The invention is directed to an improved curved intake duct through which fluid flows. The curved intake duct includes a fairing positioned upstream and adjacent to the valve stem which extends through the duct, a fairing downstream of the valve stem and adjacent thereto and a duct floor portion on the inside of the duct at the radius of curvature of the duct. The floor portion of the duct includes a flat section. The curvature including the flat section of the floor portion is decreasing radius energy curve with a height Y at a distance X which follows the following equation, where Y=the longitudinal contour of the surface area at a distance X from X=0 to X=5.1, $Y=f(x)=7.42 \cdot 10^{-7}X^4-1.42 \cdot 10^{-4}X^3+1.36 \cdot 10^{-2}X^2-2.20 \cdot 10^{-2}X-3.56 \cdot 10^{-3}$. The fairings and the floor portion can be used separately or in any combination thereof. The improvement provided by each separate element is additive. The use of all elements provides maximum efficiency to fluid flow through the duct.

20 Claims, 2 Drawing Sheets

CURVED INTAKE DUCT HAVING IMPROVED FLOW CHARACTERISTICS

This is a divisional of co-pending patent application Ser. No. 07/227,472 now U.S. Pat. No. 4,838,219 filed on Aug. 1, 1988.

BACKGROUND OF THE INVENTION

The invention is directed to fluid mechanics and more particularly to the design of a curved intake duct through which fluid flows, for example, a reciprocating internal combustion engine of the spark ignition type.

It has long been known that the power which can be delivered by any engine in which fuel is burned with air is limited by the rate at which it can take in air, combine it with fuel, and exhaust the products. The key to high sustained power output and reduction of contaminants in combustion products is easy breathing.

Some of the energy released from the fuel on combustion has to be used to pull air in and to push combustion products out. The smaller the amount of energy required, obviously, the greater will be both the useful work available and the efficiency of the engine.

The prior art teaches that the most efficient curved intake ports for reciprocating internal combustion spark ignited engines must follow rigid principles. Those principles require that the radius of the surface or floor of the bend of the curved portion of the port must have a constant bend radius, and be adequately large and there must be no discontinuities therealong. A radius of about one quarter of the port diameter is desirable and the unobstructed area of the passage should be increased in the region of the valve guide or stem and its surrounding boss to an area greater than that at the exit from the bend. The latter principle improves the basic flow pattern within the curved duct, it reduces the turbulence of flow over obstructions, and it leads to a more uniform flow toward the outlet which has the effect of reducing the turbulence wake produced by the valve stem, guide and base. Any deviations from these fixed and long time relied on principles of intake ducts supposedly reduces the efficiency of the internal combustion engine to which they are installed.

Most of the commonly known intake ducts to which the invention may be directed are far from the above described "ideal" for a number of reasons at least two of which are economics and convenience.

With the ideal above identified intake duct in mind any improvements thereto which would be inexpensive and convenient to utilize would be widely accepted in this art.

SUMMARY OF THE INVENTION

Applicant's invention is directed to improvements in fluid flow through a curved duct and to the intaking of air and/or air combined with fuel by an internal combustion engine by modifying the so called ideally curved intake duct described above by the addition of a first aerodynamic fairing centered on and adjacent to the leading edge of the valve stem which has increased thickness linearly or otherwise toward the valve stem, a second fairing immediately beyond and adjacent to the valve which appears as a continuation thereof and the appearance of a slight flattening out of the inside of the floor of the duct through a constantly increasing bend radius of the duct in the down stream direction. The leading upstream edge of the first fairing may take the form of a knife edge, be curvilinear or any transition therebetween. The second or downstream fairing has a generally convex curvilinear leading edge that is slightly spaced from and conforms to the valve stem's curvilinear configuration. The leading edge of the downstream fairing is generally an arc of revolution less than a semi-circle. These principles of the invention have according to actual flow measurements improved the flow performance. While not all of the details of the physics involved are known, it is assumed that the reduction of turbulence is caused by the improved acceleration of fluid through the duct obtained by the invention. The bend has an increasing radius and the floor of the bend provides a cross-sectional configuration which resembles the capital letter "D" with the top half of the intake duct taking the general form of a semi-circle and the lower or floor portion taking a slight rectilinear appearance. To obtain best results the size of the floor of the duct should also be considered. Actual tests performed with different prototype devices of the invention seem to indicate that an ideal configuration for best performance exists. Thus, according to these actual tests, to achieve this efficiency, the ideal configuration given by height "Y" over the distance "X" of the rectilinear appearing portion of the floor of the duct where "Y" equals f(x), is a fifth order polynomial equation $f(x)=7.42\cdot10^{-7}X^4-1.42\cdot10^{-4}X^3+1.36\cdot10^{-2}X^2-2.20\cdot10^{-2X}-3.56\cdot10^{-3}$ between $x=0$ and $x=85.1$.

Testing has established that when used alone the upstream fairing achieves a port-flow efficiency gain of about 1%, the downstream fairing achieves a port flow efficiency gain of about 4% and the floor area of maximum duct radius when designed according to the equation above having a cross-sectional width from between the length of the radius of the duct and the diameter thereof (a "D" configuration) the engine port-efficiency is from between 2 and 10% with the maximum efficiency achieved when the duct is in the "D" configuration and a lower efficiency with the floor width of the radius of the duct at the maximum bend radius.

By combining the upstream leading and the downstream heading fairing improvements of the port, efficiency is substantially 5% and with all three improvements is in the range of 7 to 15%.

These port flow efficiencies are figured with the other components of the duct valve size, port size, cylinder and piston size and exhaust system of a given engine remaining constant.

Obviously, the addition of any or all of the improvements of the invention could increase the port flow efficiency numbers if other portions of the intake valve, cylinder, and exhaust are less efficient than ideal. In other words the employment of any or all the improvements of the invention could overcome some of the design inadequacies of the engine on which they are utilized.

An object of this invention is to improve the efficiencies through a curved duct.

Another object of this invention is to improve the efficiency of a given spark ignited internal combustion engine by improving the flow characteristics of the intake duct.

Another object of this invention is to provide a curved fluid duct wherein the radius of the curve increases in a down stream flow direction.

Another object of this invention is to provide improvements to the intake track of a spark ignited internal combustion engine by modification that can be inexpensively cast into the intake track of that engine.

This invention contemplates other objects, advantages and features which will become more fully apparent from the following detailed description taken in conjunction with the accompanying drawing figures which illustrate the preferred embodiments and in which:

DETAILED DESCRIPTION OF THE PREFERRED EMBODIMENTS OF THE INVENTION

Figure 1:
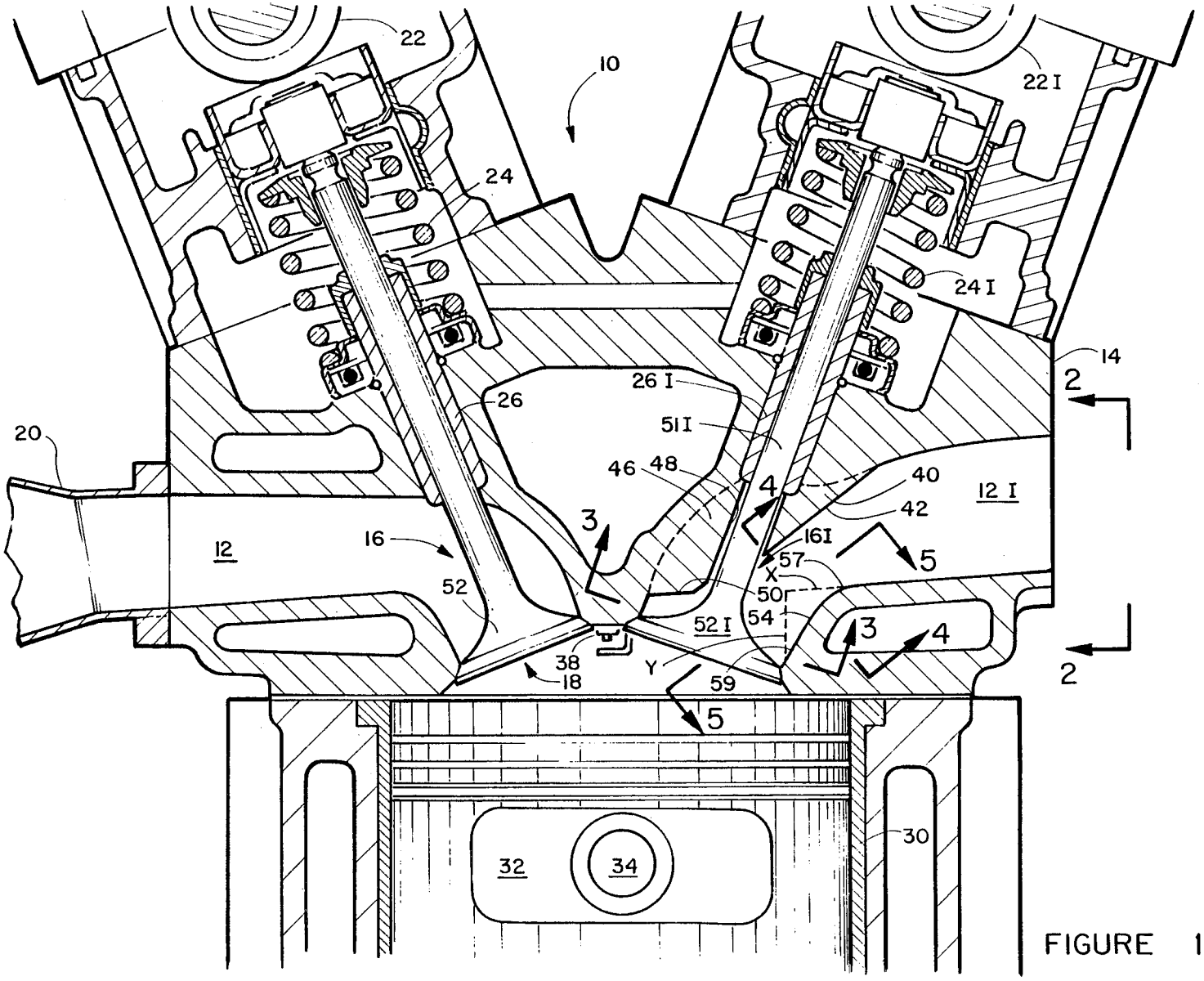
FIG. 1 is partial cut away or end view showing of a sparks ignited overhead valve engine having a curved intake port utilizing the present invention.

Referring now to the various drawing FIGS. and particularly to FIG. 1, there is shown an end cutaway of a spark ignited internal combustion engine 10, having a curved intake conduit 12I. The head portion 14 of the engine includes an exhaust conduct 12, exhaust valve 16, an exhaust port 18, and an exhaust manifold 20 which extends externally of the engine. An exhaust valve actuating cam 22, exhaust valve seating spring 24 and exhaust valve guide 26 are shown. The exhaust valve seat or port 18 is shown closed to flow from the cylinder 30 adjacent the top of piston 32. The piston 32 include a wrist pin 34 rotatably attached to a connecting rod which connects to a journal of the crank shaft neither of which are shown all of which operate in a conventional and well-known manner.

The intake side of the head to the right in the Fig. is substantially a mirror image of the exhaust side and contains like components identified with the same numeral on the exhaust side followed by the letter I designating intake.

Between the exhaust and intake valves and ports is a spark plug 38 for igniting the air and fuel combustible mixture entering the cylinder via the intake port 12I.

Figure 9:
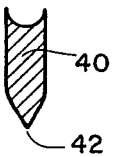
FIGS. 8 and 9 depict plan views of a traversed section of the upstream fairing showing different leading edge configurations.
Figure 8:
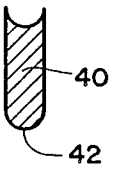

The upstream portion of the intake port include a upstream fairing 40 which has a curvilinear or knife blade leading edge 42 (see FIGS. 8 and 9). The downstream width adjacent the valve stem 16I is substantially the same as the valve stem and has a concave surface to conform to the closely adjacent cylindrical valve stem.

A second fairing 46 is positioned downstream of the valve stem 16I and has a concave upstream surface 48 which also conforms to the curvature of the cylindrical valve stem 16I. The downstream end surface 50 is positioned adjacent valve head 52I.

The floor of the intake port 12I has a substantially flat appearing surface 54 adjacent both the upstream and downstream maximum duct curved section. The flat surface 54 (f(x)) is a fifth order polynomial increasing radius power curve having the following equation: $f(x)=7.42\cdot10^{-7}X^4-1.42\cdot10^{-4}X^3+1.36\cdot10^{-2}X^{-2}-2.2\text{-}0\cdot10^{-2}X-3.56\cdot10^{-3}$ between $X=0$ and $X=85.1$.

The following are the horizontal (x) and vertical (y) data taken at 85 equally spaced apart location along line -x- of FIG. 1 as the perpendicular distance along the Y axes taken along the flat surface 54 toward the intake valve port. This surface 54 appears substantially flat toward the intake valve port between the end of the normal duct straight area at 57 to the end of the duct at 59.

| X actual | Y actual |
|---|---|
| 0 | 0 |
| 10 | 1 |
| 20 | 4 |
| 30 | 8.3 |
| 40 | 13.9 |
| 50 | 19.8 |
| 60 | 26.7 |
| 70 | 34.5 |
| 80 | 43.3 |
| 85.1 | 48.4 |

It should be understood that even though a first fairing 40, a second fairing 46 and a flat bottom surface 54 are all shown in FIG. I. They need now necessarily be employed together as each separately enhances the efficiency of the engine to which it is installed. Any one or any combination may be separately employed. Improved engine efficiency will occur in any combination. The first fairing 40 provides approximately 1% improvement, the second fairing 46 provides approximately 4% improvement and the floor surface between 57 and 59 provides from 2% to 10% improvement. These improvements are additive in any combination. If all are installed an improvement in the range of 7 to 15% will result.

Figure 2A:
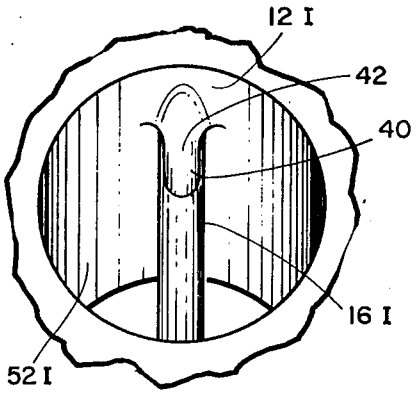
FIG. 2A is a perspective showing taken along line 2—2 of FIG. 1 with the intake valve installed.
Figure 2B:
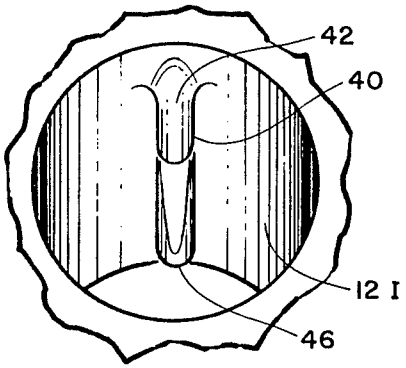
FIG. 2B is a perspective showing taken along line 2—2 of FIG. 1 with intake valve removed.

Referring now specifically to FIGS. 2A and 2B both of which are views of the intake duct 12I looking toward the engine cylinder taken along line 2—2 of FIG. 1. The valve 16I is installed in the 2A showing and omitted for clarity in the 2B showing. THe first fairing 40 and the valve stem 51I and head 52I are shown in FIG. 2A and the first and second fairings 40 and 46 respectfully are shown in FIG. 2B.

Figure 3A:
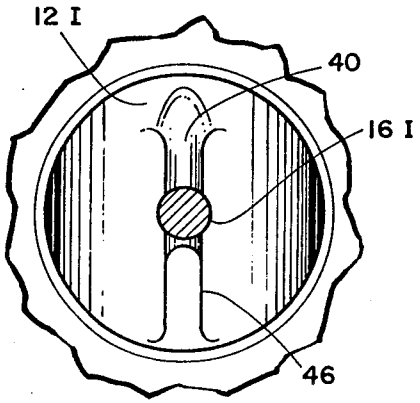
FIG. 3A is a perspective showing taken along line 3—3 of FIG. 1 with the intake valve installed.
Figure 3B:
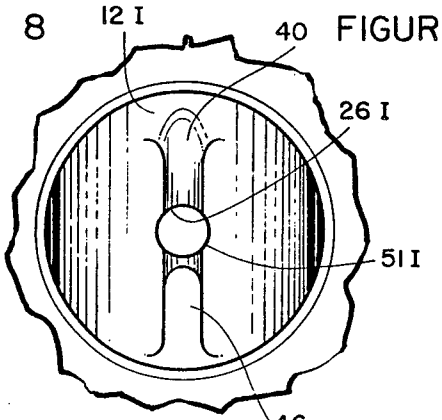
FIG. 3B is a perspective showing taken along line 3—3 of FIG. 1 with the intake valve removed.

Referring now specifically to FIGS. 3A and 3B both of which are taken from the valve port upstream along line 3—3 of FIG. 1. The valve is installed in the FIG. 3A showing and omitted for clarity in the FIG. 3B showing. In FIG. 3A the first and second fairings 40 and 46 respectfully and the valve stem 51I are shown and in FIG. 3B the first and second fairings 40 and 46 and the valve stem aperture 53I are shown.

Figure 4:
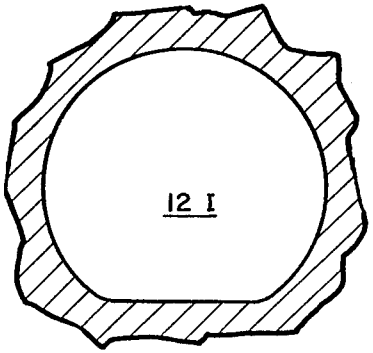
FIG. 4 is a schematic showing taken along line 4—4 of FIG. 1 of a typical valve port configuration of the invention.
Figure 5:
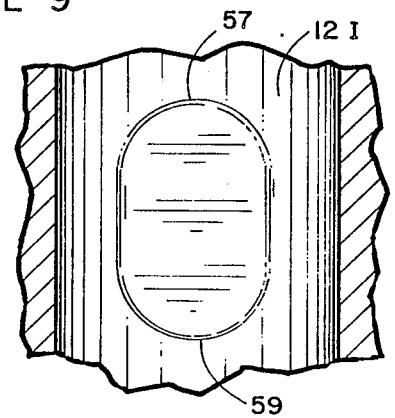
FIG. 5 is a showing of the intake duct floor of FIG. 4.

Referring now specifically to FIGS. 4 and 5. FIG. 4 is a showing of FIG. 1 taken along line 4—4 which shows the general configuration of the cross-section of the duct of the invention taken along the bend radius. FIG. 5 is showing of the intake duct floor of FIG. 4.

Figure 6:
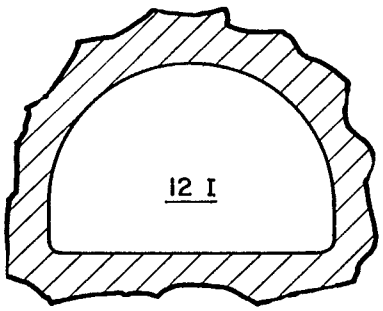
FIG. 6 is a schematic showing taken along line 4—4 of FIG. 1 of an ideal valve port configuration employing the invention.
Figure 7:
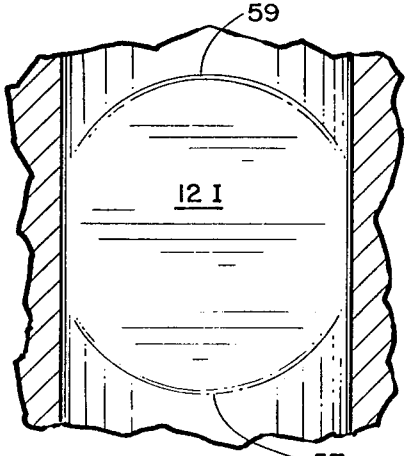
FIG. 7 is a showing of the intake duct floor of FIG. 6.

Referring now specifically to FIGS. 6 and 7. FIG. 6 is a showing of FIG. 1 taken along line 4—4 which shows a second or ideal configuration of the cross-section of the duct along the bend radius at line 4—4. FIG. 7 is a showing of the intake duct floor of FIG. 6.

It should be understood that the intake duct 12I can be formed in any degree of a circular cross-section between the showing of FIGS. 4 and 6 to practice the invention. The FIG. 6 showing being the ideal configuration for maximum efficiency. It should be understood that in all designs the cross-sectional area of the intake duct should be substantially equal to the cross-sectional area of the valve port associated therewith.

It should be further understood that although the preferred embodiment of the invention is directed to an intake tract of an internal combustion engine, the invention can be employed for any curved conduct or duct through which a fluid flows to decrease the turbulence and improve the flow of that fluid therethrough.

Although the foregoing invention has been described in some detail by way of illustration and example, for the purpose of clarity of understanding, it should be understood that certain changes and modifications may be practiced within the spirit of the invention as limited only by the scope of the appended claims.

What is claimed as new and useful and desired to be secured by United States Letters Patent is:

1. In a device using a curved intake duct having a radius of curvature and extending between an upstream end and a valve port which leads into a cylinder; an intake valve means actuated by a cam, said intake valve means including a cylindrical valve stem which extends through said curved intake duct from said cam between the upstream end and said intake port; a valve head conforming to said intake valve port; and an improved fluid flow path through said curved intake duct comprising:

a first fairing, having a width approximately the same as the diameter of said valve stem, with an upstream and downstream end, which is positioned intermediate said upstream end of said duct and said valve stem, the downstream end of said first fairing located closely adjacent to said valve stem, said end of said first fairing adjacent to said valve stem being curvilinear.

2. The invention as defined in claim 1 wherein the width of said first fairing between its ends is substantially equal to diameter of said first valve stem.

3. The invention as defined in claim 1 wherein the upstream end of said first fairing remote from said valve stem is curvilinear.

4. The invention as defined in claim 1 wherein the upstream end of said first fairing remote from said valve stem forms a knife edge.

5. The invention as defined in claim 1 wherein the vertical elevation of said first fairing increases toward said first valve stem.

6. The invention as defined in claim 1 wherein said downstream end of said first fairing adjacent to said valve stem is substantially a concave semi-circle.

7. The invention as defined in claim 1 wherein said downstream end of said fairing adjacent to said stem is concave.

8. An internal combustion engine having an intake tract comprising a curved intake duct extending between an upstream end and an intake valve port leading to a cylinder; and intake valve means, said intake valve means comprising a cylindrical valve stem which extends through said curved intake duct between said cam and said intake valve port; and improved fluid flow path through said curved intake duct comprising:

a fairing having upstream and downstream ends with a width between said upstream and downstream ends approximately the same as the diameter of said valve stem positioned intermediate said intake valve stem and intake valve port; said upstream end surface being positioned adjacent to said intake valve stem.

9. The invention as defined in claim 8 wherein the upstream end of said faring is substantially a concave semi-circle.

10. The invention as defined in claim 8 wherein the width of said fairing between its ends is substantially equal to the diameter of said intake valve stem.

11. In a device employing a curved duct having an upstream and downstream end with a cylindrical valve stem having a diameter extending across said duct intermediate the upstream and downstream ends thereof, an improved flow path comprising:

a fairing having longitudinal and transverse dimensions between its upstream and downstream end, the width of said fairing at its widest dimension is substantially the same as said diameter of said stem, said fairing being positioned within said duct intermediate said upstream end and said stem with said downstream end of said fairing closely adjacent to and terminated at said stem.

12. The invention as defined in claim 11 wherein the end of said fairing remote from said stem is curvilinear.

13. The invention as defined in claim 11 wherein the surface of said fairing which is exposed to the duct forms a knife edge.

14. The invention as defined in claim 11 wherein the end of said fairing adjacent to said stem is substantially a semi-circle.

15. The invention as defined in claim 11 wherein said curved duct includes an upper surface and a floor surface and said floor surface has a decreasing radius of curvature between it upstream and downstream end.

16. The invention as defined in claim 11 wherein the surface of said fairing exposed to the duct is curvilinear.

17. In a device employing a curved duct having an upstream and downstream end with a cylindrical shaft extending across said duct intermediate the ends thereof, an improved fluid flow path comprising:

a fairing having an upstream end positioned intermediate said shaft and said downstream end of said duct, said upstream and downstrean end of said fairing having an obtuse angle therebetween with the corner of the angle formed therebetween being removed and having said upstream end of said fairing positioned closely adjacent to said shaft.

18. The invention as defined in claim 17 wherein the width of said fairing between its ends is substantially equal to the diameter of said shaft.

19. The invention as defined in claim 17 wherein said fairing includes a concave end closely adjacent to said shaft which is substantially semi-circular.

20. The invention as defined in claim 17 wherein said curved duct includes an upper surface and a floor surface and said floor surface has a decreasing radius of curvature between it upstream and downstream end.

* * * * *